US006970060B2

(12) United States Patent
Iwata et al.

(10) Patent No.: US 6,970,060 B2
(45) Date of Patent: Nov. 29, 2005

(54) MICRO RELAY OF WHICH MOVABLE CONTACT REMAINS SEPARATED FROM GROUND CONTACT IN NON-OPERATING STATE

(75) Inventors: Hideki Iwata, Shinagawa (JP); Hirofumi Saso, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/878,233

(22) Filed: Jun. 29, 2004

(65) Prior Publication Data

US 2004/0239456 A1 Dec. 2, 2004

Related U.S. Application Data

(62) Division of application No. 10/305,119, filed on Nov. 27, 2002, now Pat. No. 6,828,888.

(30) Foreign Application Priority Data

Feb. 19, 2002 (JP) ..... 2002-042033

(51) Int. Cl.[7] ..... H01H 51/22
(52) U.S. Cl. ..... 335/78; 200/181
(58) Field of Search ..... 335/78–86, 124, 335/128; 200/181; 361/56, 58, 111

(56) References Cited

U.S. PATENT DOCUMENTS 4,517,537 A * 5/1985 Weiser et al. ..... 335/187
5,372,515 A 12/1994 Miller et al.
5,606,447 A * 2/1997 Asada et al. ..... 359/199
5,872,496 A 2/1999 Asada et al.
6,016,092 A 1/2000 Qiu et al.
6,034,583 A * 3/2000 Dittmann ..... 335/78
6,107,903 A * 8/2000 Sako et al. ..... 335/78
6,140,895 A * 10/2000 Dittmann et al. ..... 335/80
6,504,447 B1 1/2003 Laney et al.
2001/0038326 A1 * 11/2001 Dittmann ..... 335/80
2002/0123270 A1 9/2002 Belopolsky
2003/0008538 A1 1/2003 Murnaghan et al.

FOREIGN PATENT DOCUMENTS

EP 1143473 A2 * 10/2001 ..... H01H 50/54
JP 2-100224 4/1990
JP 5-242788 9/1993
JP 9-17300 1/1997
JP 9-92116 4/1997
JP 11-260233 9/1999
JP 2001-52587 2/2001
WO 200167476 A1 9/2001

* cited by examiner

*Primary Examiner*—Lincoln Donovan
*Assistant Examiner*—Bernard Rojas
(74) *Attorney, Agent, or Firm*—Staas & Halsey LLP

(57) ABSTRACT

A micro relay is provided including a movable contact, a stationary contact, and a ground contact opposed to the movable contact. In an operating state, the movable contact touches the ground contact when the movable contact separates from the stationary contact. In a non-operating state, the movable contact remains separated from the ground contact so that the movable contact does not stick to the ground contact. Since no parasitic capacitance is formed between the stationary contact and the movable contact, the isolation property of the micro relay is improved.

6 Claims, 23 Drawing Sheets

MICRO RELAY OF WHICH MOVABLE CONTACT REMAINS SEPARATED FROM GROUND CONTACT IN NON-OPERATING STATE

This application is a divisional of application Ser. No. 10/305,119, filed Nov. 27, 2002, now U.S. Pat. No. 6,828, 888.

BACKGROUND OF THE INVENTION

1. Field of the Invention

The present invention relates to a micro relay, and more particularly, to a micro relay that is activated by electrostatic attractive force and manufactured using semiconductor manufacturing techniques such as film forming, exposure, and etching.

2. Description of the Related Art

An ordinary relay is switched by current flowing in a winding provided therein. The current generates electromagnetic force that activates a contact point formed on a leaf spring. It is difficult to make the ordinary relay small and less power-consuming, however, due to such structure of the conventional relay. To solve this problem, a micro relay has been developed. The micro relay is manufactured using manufacturing processes of a semiconductor apparatus, such as film forming, exposure, and etching. The micro relay is activated by electrostatic attractive force, electromagnetic force, piezoelectric distortion, thermal expansion, and so forth. This micro relay is expected to break through the conventional limit in size and power consumption.

The micro relay is suitable for switching signal lines in which only weak current flows. One of the best applications of the micro relay is to switch high frequency signals. The micro relay is required to have a good isolation property. The isolation property indicates the amount of signals that leak between opening contacts. The smaller the amounts of signals that leak, the better isolation property the micro relay has.

An effective way to improve the isolation property is to reduce the areas of the opening contacts facing each other and to increase the distance between the opening contacts facing each other so as to reduce the electrostatic capacity connection between the opening contacts facing each other. In the case of the micro relay, the areas of the opening contacts facing each other are easily reduced. However, increasing the distance between the opening contacts facing each other is not easy since voltage that is practically applicable to the micro relay is limited to about 10 V, and the resulting activating force generated by the electrostatic attractive force is weak.

FIGS. 1 and 2 show a micro relay 10 that is disclosed in Japanese Laid-open Patent Application No. 2001-52587. The micro relay 10 is structured by laminating a fixed substrate 20, a movable substrate 30, and a cap member 40. Signal wirings 11, 12 and stationary contacts 13, 14 are formed on the top face of the fixed substrate 20. The fixed substrate 20 itself forms a stationary contact. The movable substrate 30 has a movable contact 31 on its bottom face and an upper contact unit 32 and a movable electrode 33 on its top face. The movable contact 31 and the movable electrode 33 are electrically connected to each other. The cap member 40 has a conductive layer 41 on the bottom face. When the micro relay 10 is mounted on a printed board, the conductive layer 41 is grounded.

When the micro relay 10 is activated by the applying of voltage, the electrostatic attractive force generated between the fixed substrate 20 and the movable electrode 33 bends the movable substrate 30 downward, and causes the movable contact 31 to contact the stationary contacts 13, 14. Accordingly, the signal wirings 11 and 12 are electrically connected by the movable contact 31.

When the applying of voltage to micro relay 10 is discontinued, the movable substrate 30 restores itself, and the movable contact 31 separates from the stationary contacts 13, 14. Then, the upper contact unit 32 contacts the conductive layer 41, and the movable contact 31 is grounded. Because the movable contact 31 is grounded, the electrostatic capacity between the movable contact 31 and the stationary contacts 13, 14 is eliminated. Though the distance between the movable contact 31 and the stationary contacts 13, 14 is short, the isolation property of the micro relay is good.

However, because the upper contact unit 32 contacts the conductive layer 41, the upper contact unit 32 may stick on the conductive layer 41. The electrostatic attractive force generated between the fixed substrate 20 and the movable electrode 33 by the voltage applied to the micro relay is not strong.

In situations where the upper contact unit 32 is stuck to the conductive layer 41 even in the least, the micro relay 10 is not activated even if the voltage is applied.

SUMMARY OF THE INVENTION

Accordingly, it is a general object of the present invention to provide a novel and useful micro relay in which one or more of the problems described above are eliminated.

To achieve one of the above objects, a micro relay according to the present invention includes a movable contact, a stationary contact, and a ground contact opposed to said movable contact, wherein in an operating state, said movable contact touches said ground contact when said movable contact separates from said stationary contact, and in a non-operating state, said movable contact remains separated from said ground contact.

In the operating state, the movable contact touches the ground contact and is set at the ground voltage level when the movable contact separates from the stationary contact. Since no parasitic capacitance is formed between the stationary contact and the movable contact, the isolation property of the micro relay is improved.

In the non-operating state, the movable contact separates from the ground contact so that the movable contact does not stick to the ground contact. Accordingly, the micro relay operates at high reliability even at the beginning of the operation.

Other objects, features, and advantages of the present invention will become more apparent from the following detailed description when read in conjunction with the accompanying drawings.

DETAILED DESCRIPTION OF THE PREFERRED EMBODIMENTS

[The First Embodiment]

Figure 1:
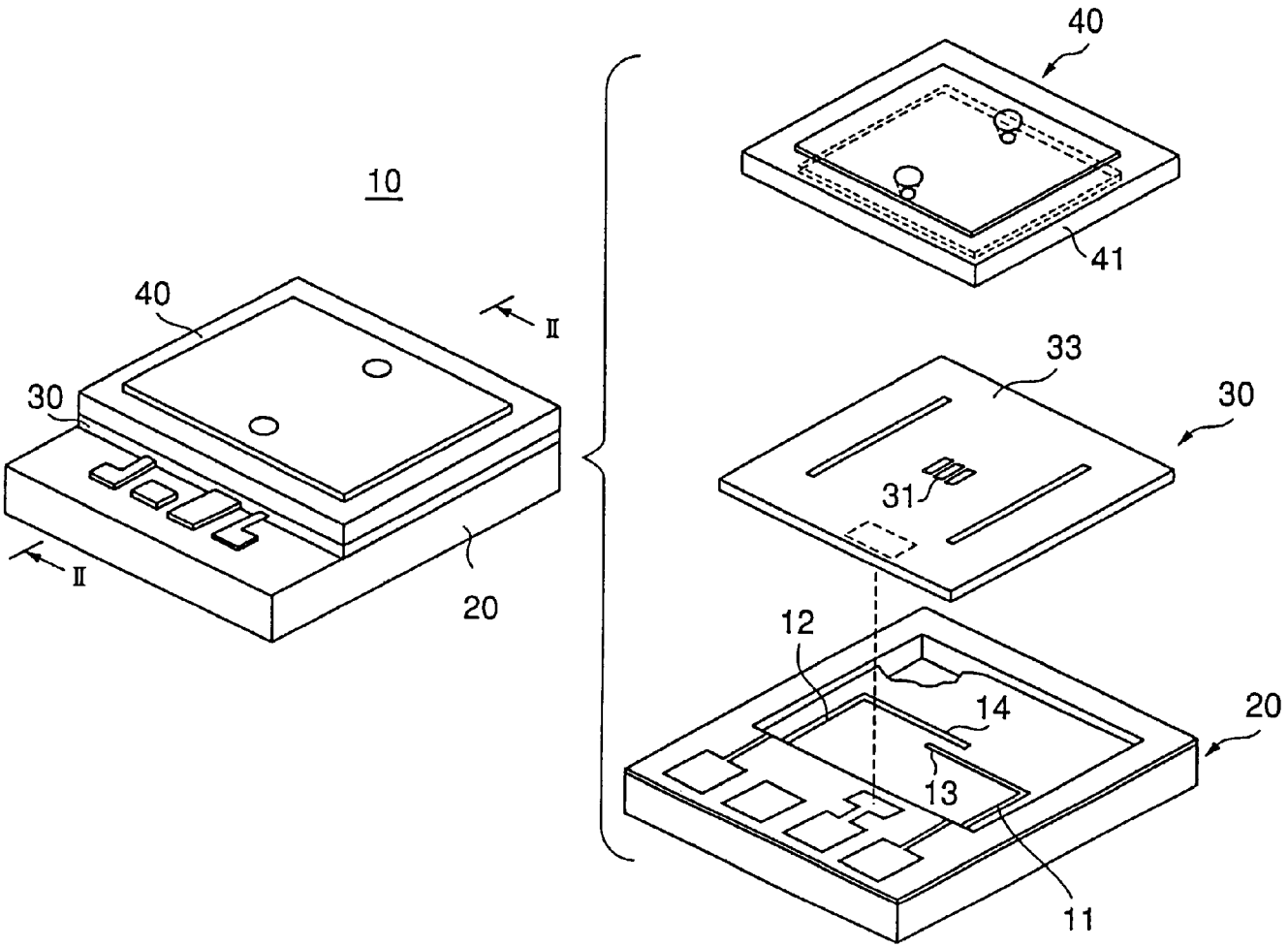
FIG.1 (PRIOR ART)
FIG. 1 is a schematic drawing showing a conventional micro relay.
Figure 2:
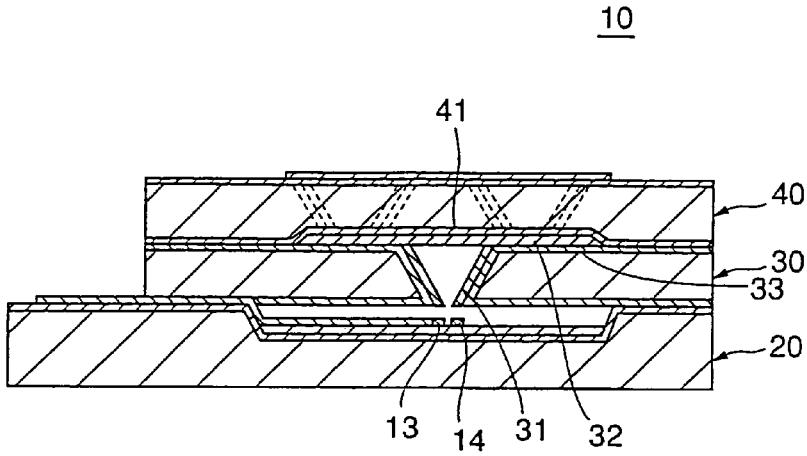
FIG.2 (PRIOR ART)
FIG. 2 is a sectional view of the conventional micro relay shown in FIG. 1, along a perpendicular plane including the II—II line.
Figure 3:
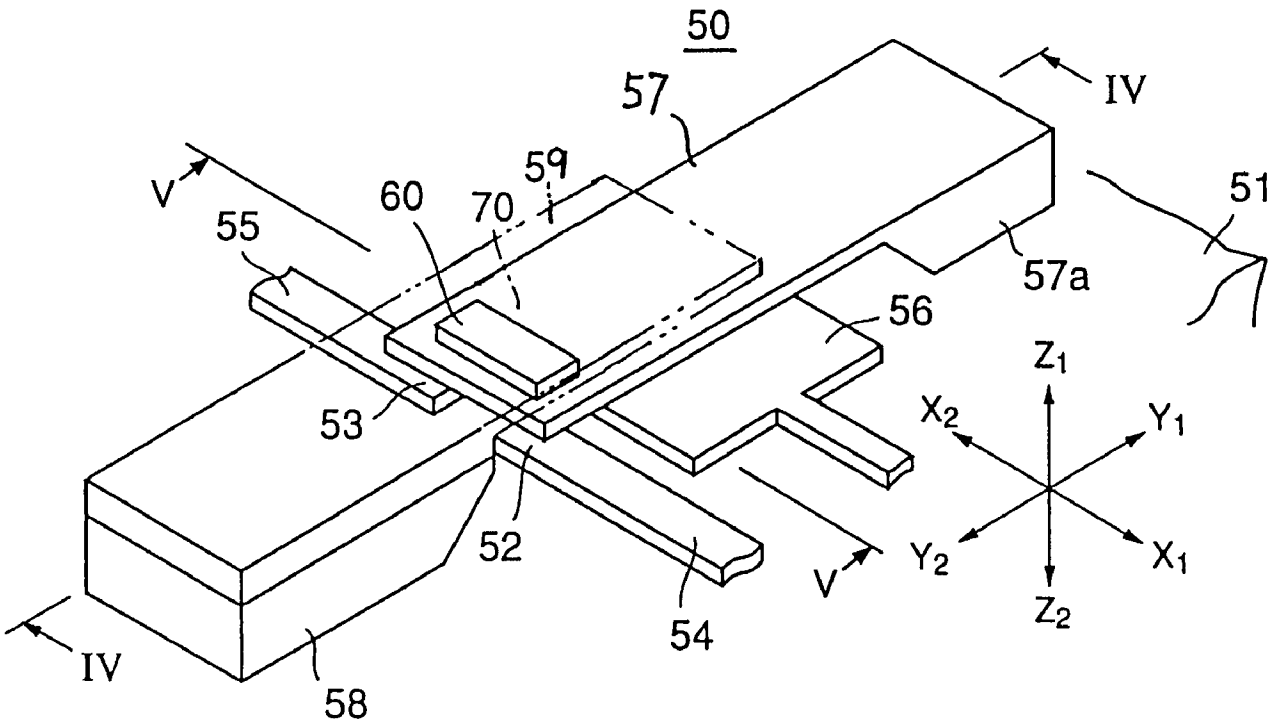
FIG. 3 is a perspective view showing a micro relay according to the first embodiment of the present invention.
Figure 4:
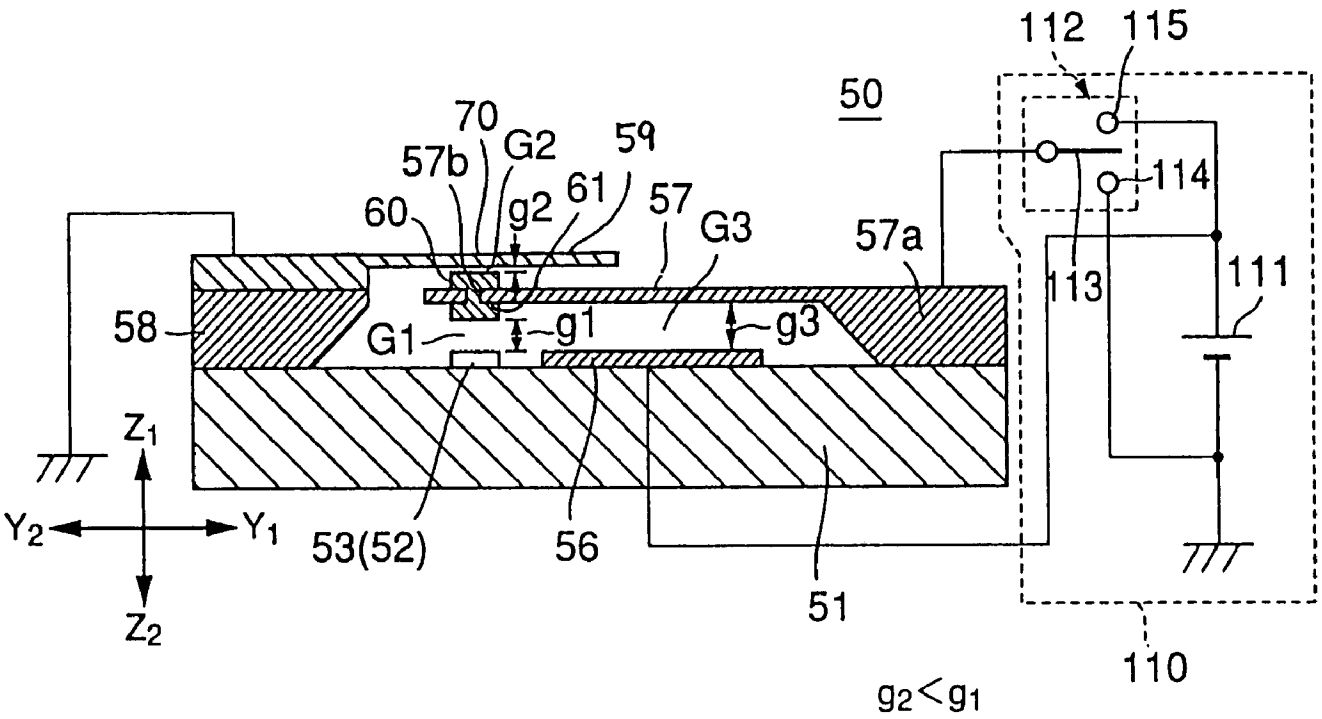
FIG. 4 is a sectional view showing the micro relay shown in FIG. 3, along a perpendicular plane including the IV—IV line.
Figure 5:
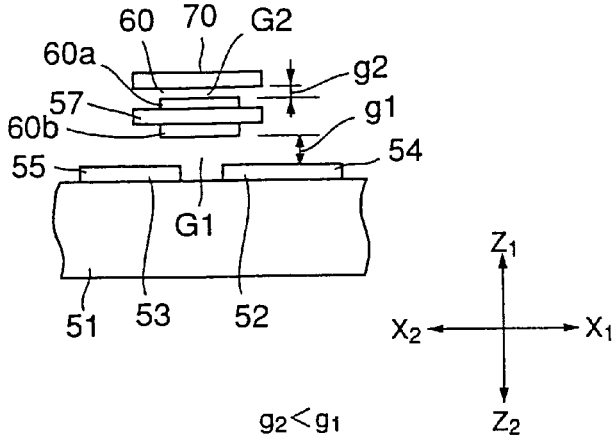
FIG. 5 is a sectional view showing the micro relay shown in FIG. 3, along a perpendicular plane including the V—V line.
Figure 6:
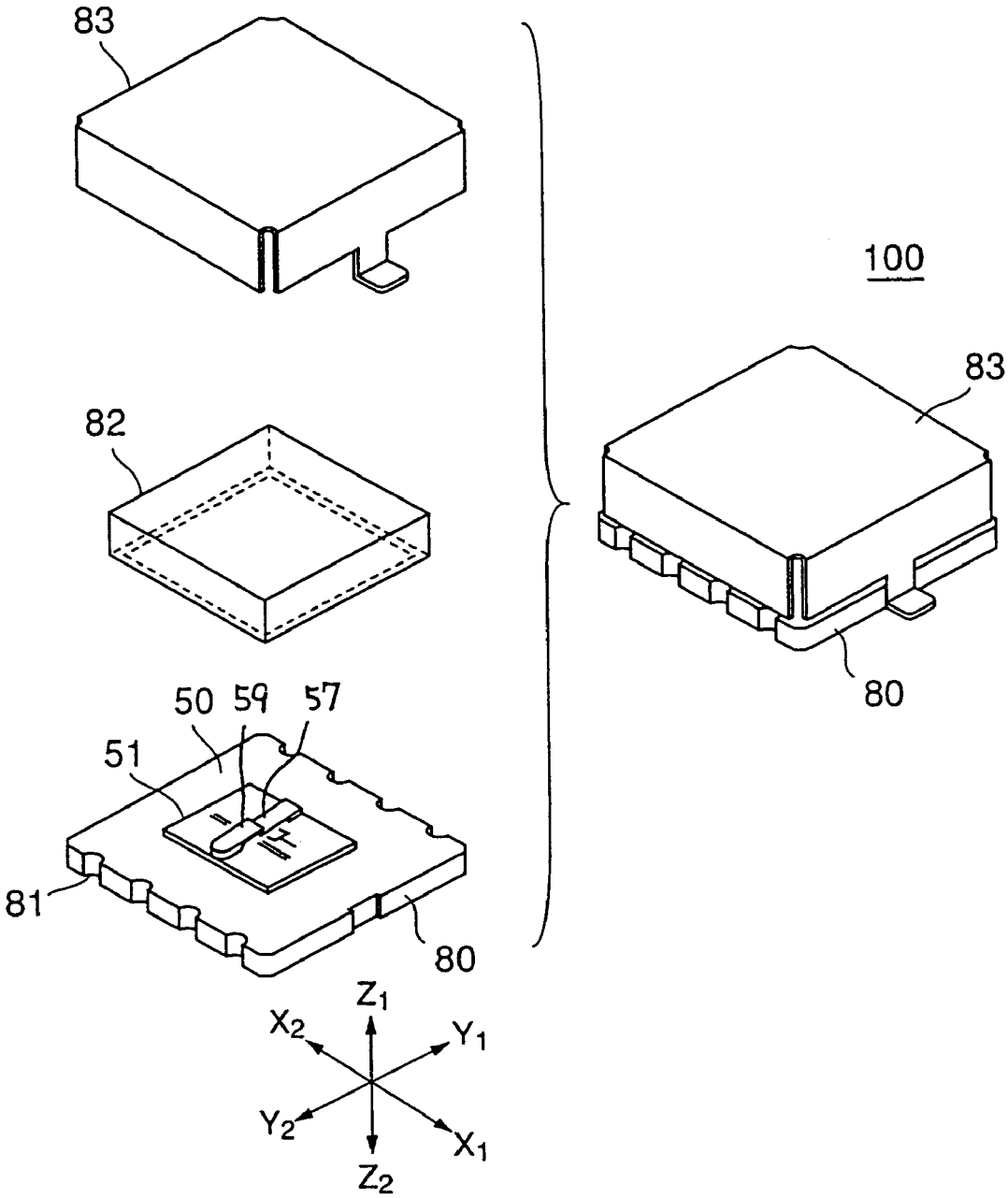
FIG. 6 is a schematic drawing showing a micro relay apparatus incorporating the micro relay shown in FIG. 3.

FIGS. 3, 4, and 5 show the main structure of a micro relay 50 according to the first embodiment of the present invention. FIG. 6 shows a micro relay apparatus 100. X1–X2 indicates the direction of width, Y1–Y2 indicates the direction of length, and Z1–Z2 indicates the direction of height.

As shown in FIGS. 3, 4, and 5, the micro relay 50 is a single pole single throw (SPST) type with chip-shaped structure comprising stationary contacts 52, 53, a movable contact 60, and a ground contact 70 formed on a fixed substrate 51 made of glass using semiconductor manufacturing techniques such as film forming, exposure, and etching. As shown in FIG. 6, the micro relay 50 becomes a finished product, the micro relay apparatus 100, by being covered with a cap 83 made of metal plate. This micro relay apparatus 100 is mounted on the printed board and activated by a drive circuit 110 shown in FIG. 4.

As shown in FIGS. 3, 4, and 5, signal lines 54, 55, a stationary electrode 56, a movable plate 57, a base unit 58, a ground terminal 59, and so forth are formed on a substrate 51. The movable plate 57, the base unit 58, and the ground terminal 59 are made of semiconductor material such as poly-silicon. The stationary contacts 52, 53 are provided at the end of the signal lines 54, 55, respectively, and separated by a predetermined distance in the X1–X2 directions. The movable plate 57 is cantilever-shaped. Its base 57*a* positioned at the Y1 side is fixed on the substrate 51. The movable plate 57 stretches in the Y2 direction and overpasses the stationary electrode 56. The movable plate 57 bends elastically in the directions of Z1–Z2. The movable contact 60 is provided around the point (Y2 end) of the movable plate 57. The movable contact 60 extends through the movable plate 57 through a through-hole 57*b* (FIGS. 4 and 5). It has an upper side movable contact 60*a* protruding upwardly from the upper face of the movable plate 57 and a lower side movable contact 60*b* protruding downwardly from the lower face of the movable plate 57. An insulating film 61 is provided between the movable plate 57 and the movable contact 60.

The ground terminal 59 is formed on the top face of the base unit 58 on the substrate 51. The ground terminal 59 is positioned at a height higher than the movable plate 57 and protrudes in the Y1 direction over the movable contact 60. (In FIG. 3, the portion of the ground terminal 59 that overlaps the movable plate 57 is drawn with a double dashed chain line as if it is transparent.) A ground contact 70 is positioned about at the center of the directions of length of the ground terminal 59 and over the movable contact 60. The ground terminal 59 is stretched beyond over the movable contact 60 in the Y1 direction because, as described in more detail later, the areas of the movable plate 57 and the ground terminal 59 facing each other are required to be as large as possible so as to enhance the electrostatic attractive force between the movable plate 57 and the ground terminal 59.

The movable contact 60 is positioned between the stationary contacts 52, 53 and the ground contact 70 in the directions of Z1–Z2 and is separated from both the stationary contacts 52, 53 and the ground contact 70. There is a gap G1 between the movable contact 60 and the stationary contacts 52, 53, and there is a gap G2 between the movable contact 60 and the ground contact 70. The gap G1 has a gap length of g1, and the gap G2 has a gap length of g2. The gap length g1 is about 10 $\mu$m, and the gap length g2 is several $\mu$m. The gap length g2 is shorter than the gap length g1 because it is difficult to make the area of the movable plate 57 and the ground terminal 59 facing each other larger than that of the movable plate 57 and the stationary electrode 56 facing each other, and as a result, the electrostatic attractive force between the movable plate 57 and the ground terminal 59 is weaker than that between the movable plate 57 and the stationary electrode 56. There is another gap G3 having a gap length g3 of about 10 $\mu$m between the movable plate 57 and the stationary electrode 56.

FIG. 6 is a schematic diagram showing a micro relay apparatus 100. The micro relay 50 structured as described above is fixed on a frame substrate 80 having terminals around it by wire bonding or flip-chip bonding, sealed in a glass case 82, and covered by a metal cap 83. The cap 83 is connected to the ground terminal of the frame substrate 80. Accordingly, the parasitic capacitance of the frame substrate 80 and the glass case 82 is reduced so that the micro relay apparatus 100 has a desired high frequency property.

This micro relay apparatus 100 is surface-mounted on a printed circuit board. The operation of the micro relay 50 will be described below.

A drive circuit 110 is connected to the micro relay 50 as shown in FIG. 4. The reference numeral 111 indicates a power supply, and the reference numeral 112 indicates a switch. A positive voltage is applied to the stationary electrode 56. The switch 112 controls the voltage applied to the movable plate 57. The switch 112 may be configured by a transistor or an IC. The ground terminal 59 is grounded.

A "non-operating state" refers to the state where the micro relay 50 is not operated, and the electrostatic attractive force is not generated. An "operating state" refers to the state where the micro relay 50 is operated, and the electrostatic attractive force is generated.

In the non-operating state, the movable contact 113 is not connected to either of the stationary contacts 114 and 115. No electrostatic attractive force is generated between the movable plate 57 and the stationary electrode 56 and between the movable plate 57 and the ground terminal 59. The movable plate 57 is not bent (it is straight) as shown in FIG. 4. As shown in FIGS. 4 and 5, the movable contact 60 is distant from the stationary contacts 52 and 53, and also distant from the ground contact 70.

Figure 7A:
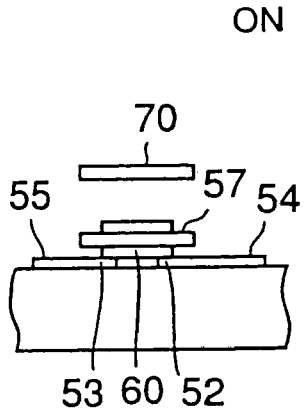
FIGS. 7A–7D are schematic drawings showing operational states of the micro relay shown in FIG. 3.
Figure 7B:
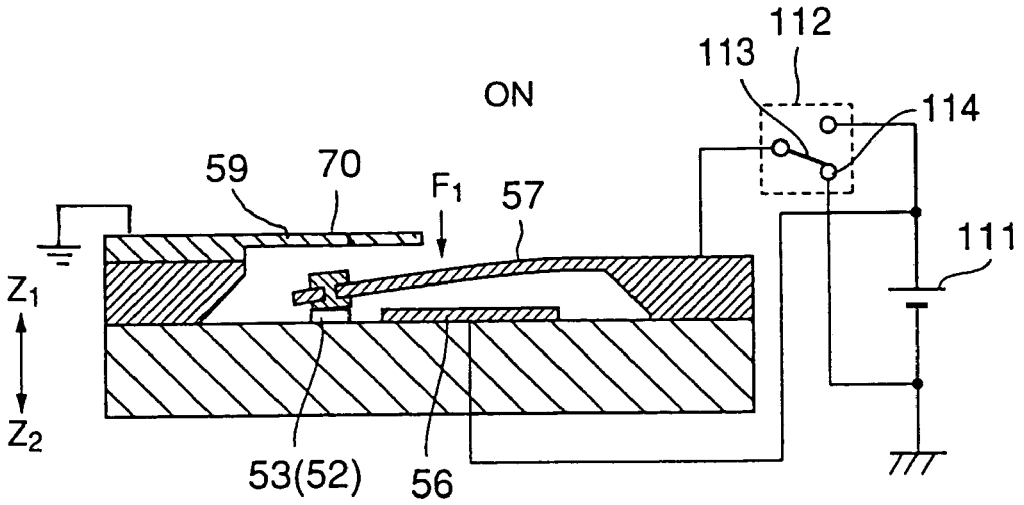
Figure 7C:
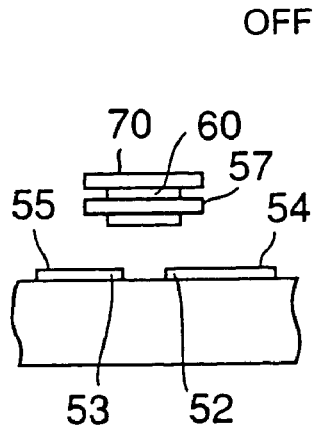
Figure 7D:
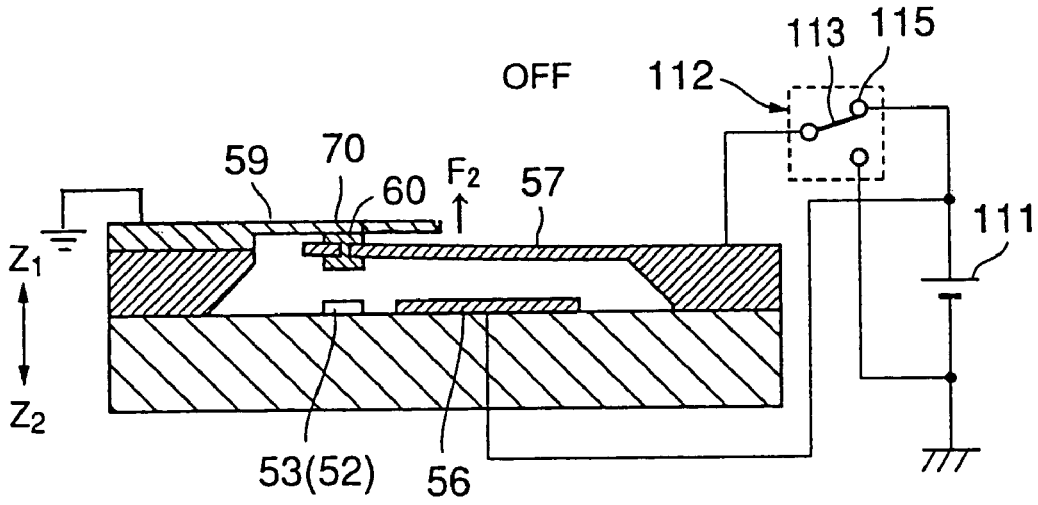

In the operating state, as shown in FIGS. 7B and 7D, the switch 112 is switched between the stationary contacts 114 and 115. As shown in FIG. 7B, when the movable contact 113 is connected to the stationary contact 114, an electrostatic attractive force is generated between the movable plate 57 and the stationary electrode 56. The movable plate 57 is attracted to the stationary electrode 56 by the electrostatic attractive force F1 indicated by an arrow and bent in the Z2 direction. As shown in FIGS. 7A and 7B, the movable contact 60 touches the stationary contacts 52 and 53, and consequently, the stationary contacts 52 and 53 are connected. The micro relay 50 is turned on, and a high frequency signal flows through the signal lines 54 and 55.

As shown in FIG. 7D, when the switch 112 is switched and the movable contact 113 is connected to the stationary contact 115 instead of the stationary contact 114, the electrostatic attractive force between the movable plate 57 and the stationary electrode 56 vanishes, the movable contact 60 separates from the stationary contacts 52 and 53 due to the movable plate 57 having an elastic restorative force. At the same time, the movable plate 57 is bent in the Z1 direction beyond the horizontal position by an electrostatic attractive force F2 indicated by an arrow, generated between the movable plate 57 and the ground terminal 59. As shown in FIGS. 7C and 7D, the movable contact 60 touches the ground contact 70.

Because the movable contact 60 separates from the stationary contact 52 and 53, the stationary contacts 52 and 53 are disconnected, and the micro relay 50 is turned off. Because the movable contact 60 touches the ground contact 70, the movable contact 60 is grounded, and the electrostatic capacitance connection between the movable contact 60 and the stationary contacts 52 and 53 vanishes. Even though the distance between the movable contact 60 and the stationary contacts 52 and 53 is short, the isolation property is good.

Since the overlapping area of the movable plate 57 and the ground terminal 59 cannot be expanded enough, the movable plate 57 requires a high voltage so as to bend the movable plate 57 towards the ground terminal 59 side. In this embodiment, however, the gap length g2 of the gap G2 is very short, only several $\mu$m long, and accordingly, only a small amount of the bending of the movable plate 57 in the Z1 direction is required. The power consumption required for keeping the movable contact 60 touching the ground terminal 70 is quite small, about 1 mW.

When the switch 112 is set in the state shown in FIG. 4, the micro relay 50 is set at the non-operating state. That is, no voltage is applied to the movable plate 57, and the electrostatic attractive force affecting the movable plate 57 vanishes. The movable plate 57 bent in the Z1 direction or the Z2 direction is restored to the horizontal position by its elastic restorative force and set at the state shown in FIGS. 4 and 5. The movable contact 60 separates from the ground contact 70 and the gap G2 is formed. Accordingly, the movable contact 60 does not stick to the ground contact 70.

One may form a conductive layer (not shown) on the bottom face of the substrate 51 and connect it to the ground. This structure reduces the parasitic capacitance of the substrate 51 and further improves the isolation property.

The drive circuit 110 shown in FIG. 4 is just an example, and the present invention is not limited to this example.

A description of the manufacturing method of the above micro relay 50 will be given below by reference to FIGS. 8 and 9.

This manufacturing method uses surface micro machining techniques. Structural layers and sacrificial layers are formed on the substrate 51 by spattering, evaporating, or plating. Finally, the sacrificial layers are removed to form the gap G2.

Figure 8A:
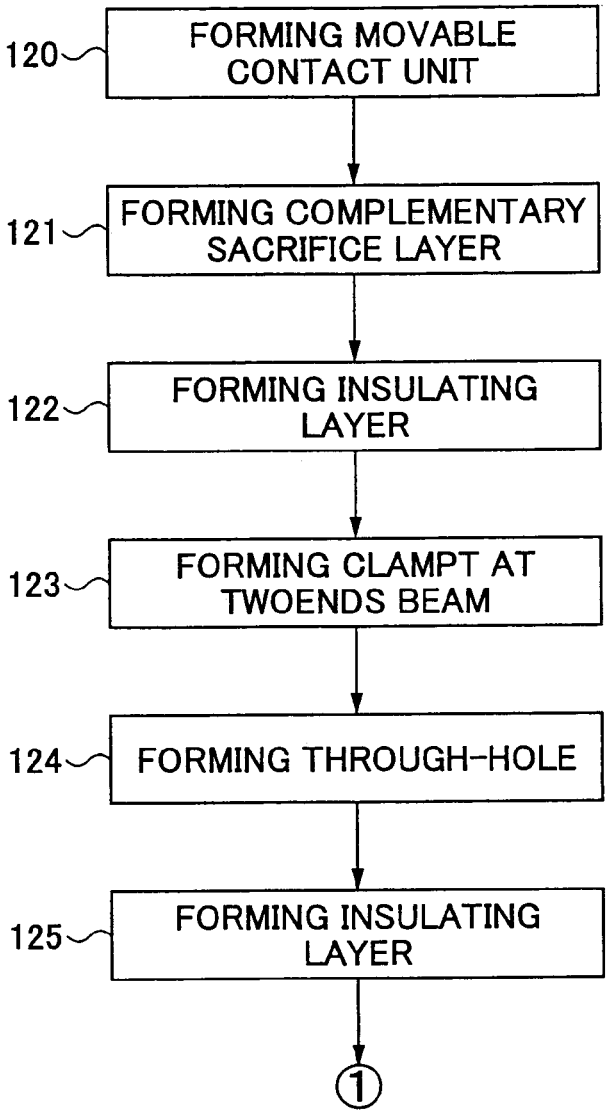
FIGS. 8A–8G are a flow chart and schematic diagrams showing the first half of the manufacturing process of the micro relay shown in FIG. 3.
Figure 9A:
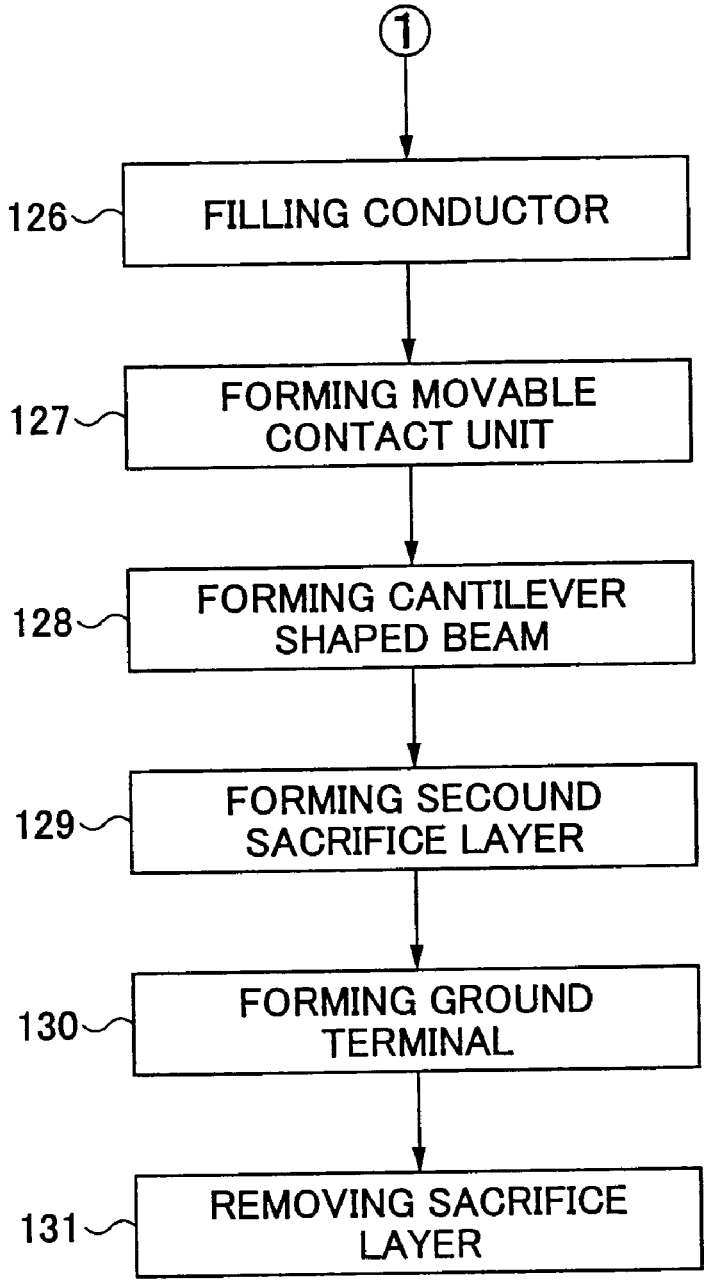
FIGS. 9A–9G are a flow chart and schematic diagrams showing the second half of the manufacturing process of the micro relay shown in FIG. 3.

FIG. 8A is a flowchart showing the first half of the manufacturing process, and FIG. 9A is a flowchart showing the second half of the manufacturing process following that shown in FIG. 8A.

Figure 8B:
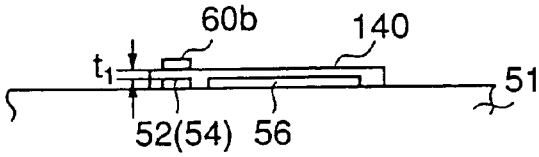

In step 120, as shown in FIG. 8B, a first sacrificial layer 140 and the lower movable contact unit 60*b* are formed on the substrate 51 on which the signal line 54, the stationary contact point 52, and the stationary electrode 56 are formed beforehand. The sacrificial layer 140 that covers the stationary contact 52 finally forms the above gap G1.

Figure 8C:
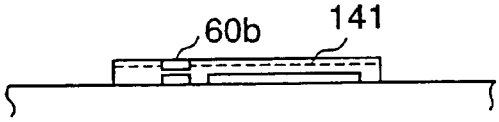

In step 121, as shown in FIG. 8C, a complementary sacrificial layer 141 is formed on the first sacrificial layer 140 so that the top face of the complementary sacrificial layer 141 is as high as the top face of the lower movable contact unit 60*b*.

Figure 8D:
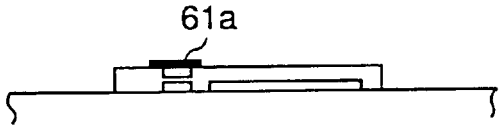

In step 122, as shown in FIG. 8D, an insulating film 61*a* is formed around the lower movable contact unit 60*b* on the complementary sacrificial layer 141.

Figure 8E:
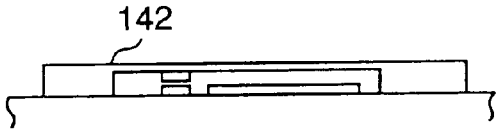

In step 123, as shown in FIG. 8E, a beam 142 clamped at the two ends made of poly silicon is formed so that it covers the complementary sacrificial layer 141.

Figure 8F:
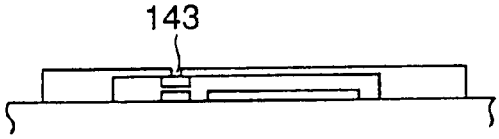

In step 124, as shown in FIG. 8F, a through hole 143 is formed at the position of the lower movable contact unit 60*b* on the beam 142 by etching.

Figure 8G:
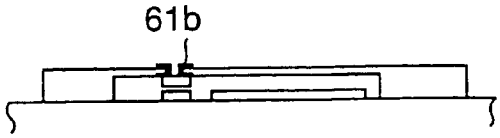

In step 125, as shown in FIG. 8G, an insulating film 61*b* is formed on the inner radius face (perpendicular portion) of the through hole 143 and the top face of the beam 142 around the through hole 143 by oxidizing with heat.

Figure 9B:
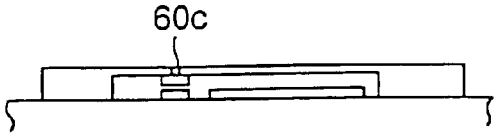

In step 126, as shown in FIG. 9B, the through hole 143 is filled with conductive material 60*c*.

Figure 9C:
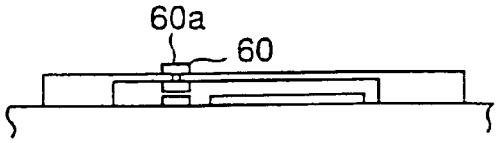

In step 127, as shown in FIG. 9C, the upper movable contact unit 60*a* is formed so that it is connected to the conductive material 60*c*. This process forms the movable contact 60.

Figure 9D:
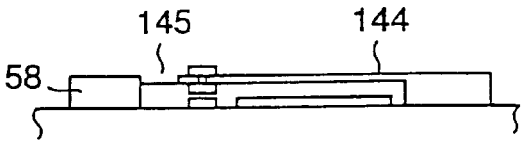

In step 128, as shown in FIG. 9D, a cantilever 144 and the base unit 58 are formed by removing a portion of the double sided beam 142 by etching. The reference numeral 145 indicates the portion that has been removed by the etching.

Figure 9E:
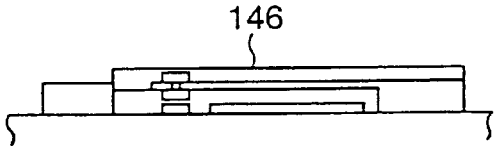

In step 129, as shown in FIG. 9E, a second sacrificial layer 146 is formed on the cantilever 144. The second sacrificial layer 146 also covers the upper movable contact unit 60*a*. The portion of the second sacrificial layer 146 that covers the upper movable contact unit 60*a* finally forms the gap G2 described above.

Figure 9F:
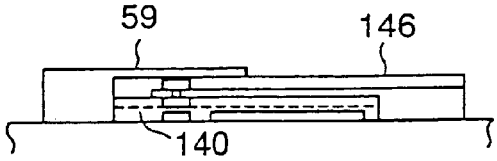

In the step 130, as shown in FIG. 9F, the ground terminal 59 is formed on the second sacrificial layer 146.

Figure 9G:
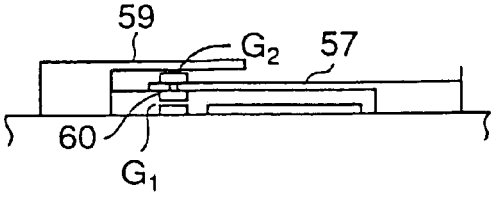

In the step 131, as shown in FIG. 9G, the first sacrificial layer 140, the complementary sacrificial layer 141, and the second sacrificial layer 146 are dissolved and removed. As a result, the movable plate 57, the gap G1 and the gap G2 are formed.

One may manufacture the movable plate 57 and the ground terminal 59 separately and attach them on the substrate on which the signal lines 54, 55, the stationary contact 52, 53, and the stationary electrode 56 are formed beforehand, by bulk micro machining techniques to manufacture the micro relay 50.

Figure 10:
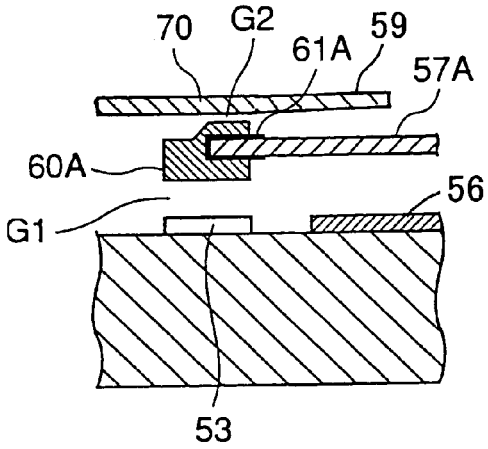
FIG. 10 is a sectional view showing a variation of the movable contact of the micro relay shown in FIG. 3.

FIG. 10 shows a variation of the above movable contact 60. This movable contact 60A is formed so that it covers the point of the movable plate 57A. An insulating film 61A is formed at the point of the movable plate 57A. The movable plate 57A does not have the above through hole 57*b*. Accordingly, the movable plate 57A and the movable contact 60A are manufactured more easily than the movable plate 57A and the movable contact 60A are.

[The Second Embodiment]

Figure 11:
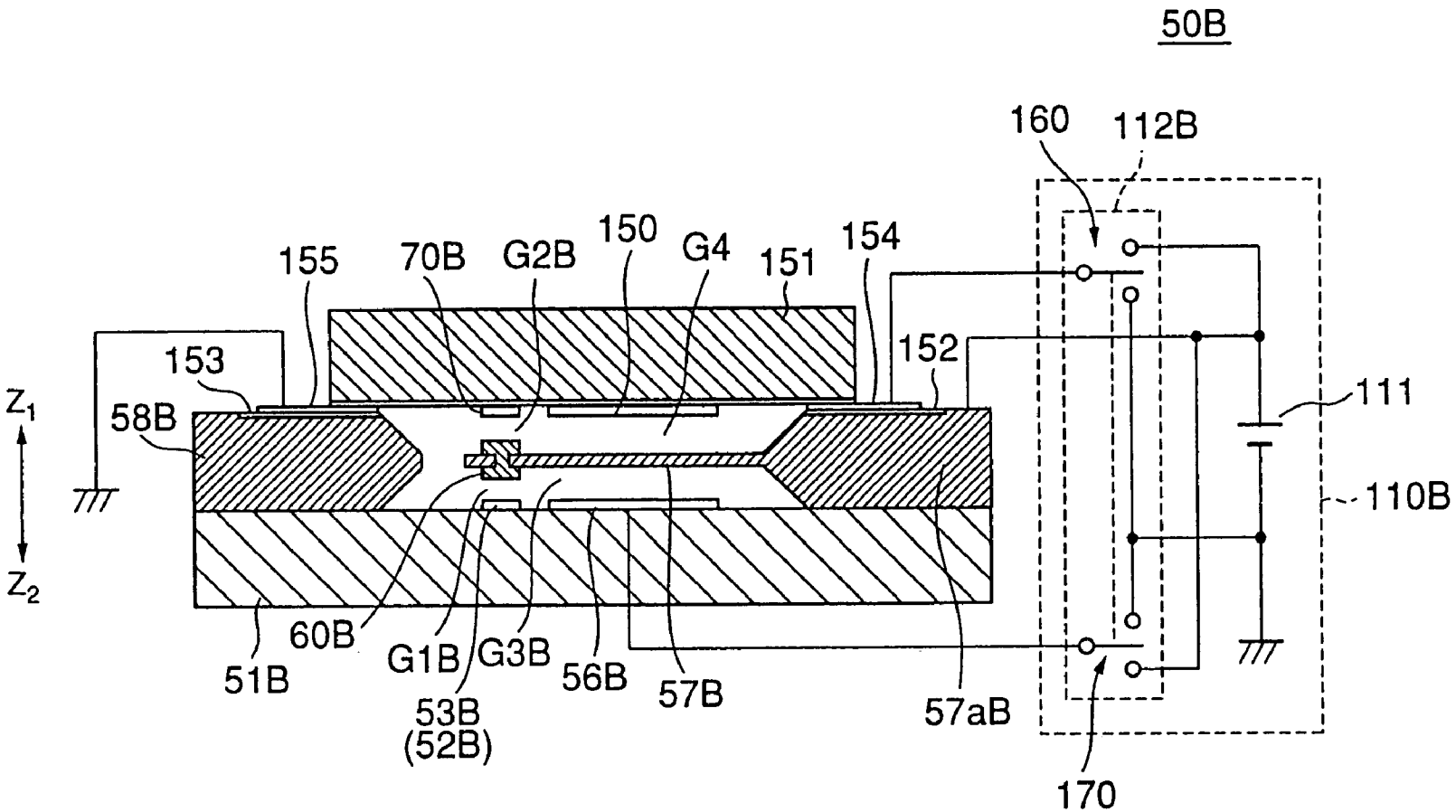
FIG. 11 is a sectional view showing a micro relay according to the second embodiment of the present invention.

FIG. 11 is a schematic diagram showing an SPST type micro relay 50B according to the second embodiment of the present invention. The micro relay 50B is different from the micro relay 50 shown in FIGS. 3 and 4 in that a stationary electrode 150 is provided over a movable plate 57B, and the gap distance of a gap G2B is longer than that of the above gap G2.

In FIG. 11, components corresponding to those shown in FIG. 4 are referred to by the same numeral followed by a suffix "B". The micro relay 50B has the same structure as the micro relay 50 shown in FIG. 4 except for the additional stationary electrode 150.

The stationary electrode 150 and a ground contact 70B are formed on the bottom face of an upper substrate 151. This substrate 151 is fixed on both a base unit 58B and a base unit 57*a*B. The stationary electrode 150 is facing the movable plate 57B. There is a gap G4 between the stationary electrode 150 and the movable plate 57B. Reference numerals 152 and 153 refer to insulating films, and reference numerals 154 and 155 refer to pulled-out terminals.

The gap G2B is larger than the gap G2 of the micro relay 50 shown in FIG. 4 since, when the micro relay 50B is turned off, strong electrostatic attractive force is generated. Because the gap G2B is large, it can be easily fabricated.

A drive circuit 110B has a switch 112B including the first switch 160 and the second switch 170 that are operated together. Positive voltage is applied to the movable plate 57B all the time.

In a non-operating state, as shown in FIG. 11, both the first switch 160 and the second switch 170 are not connected to stationary contacts. No electrostatic attractive force is generated between the movable plate 57B and the stationary electrode 56B and between the movable plate 57B and the stationary electrode 150. The movable plate 57B remains at the horizontal position. Because there is the gap G2B, the movable contact 60B does not stick on the ground contact 70B.

Figure 12A:
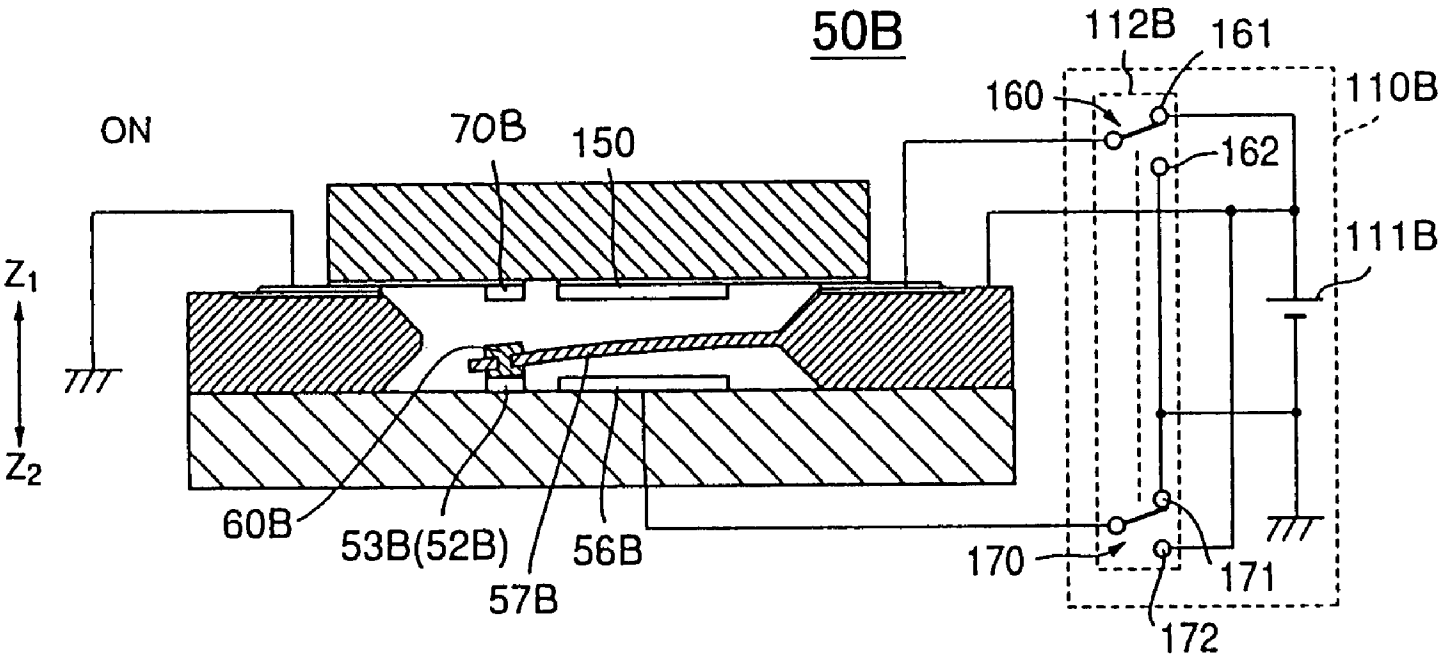
FIGS. 12A–12B are schematic drawings showing operational states of the micro relay shown in FIG. 11.
Figure 12B:
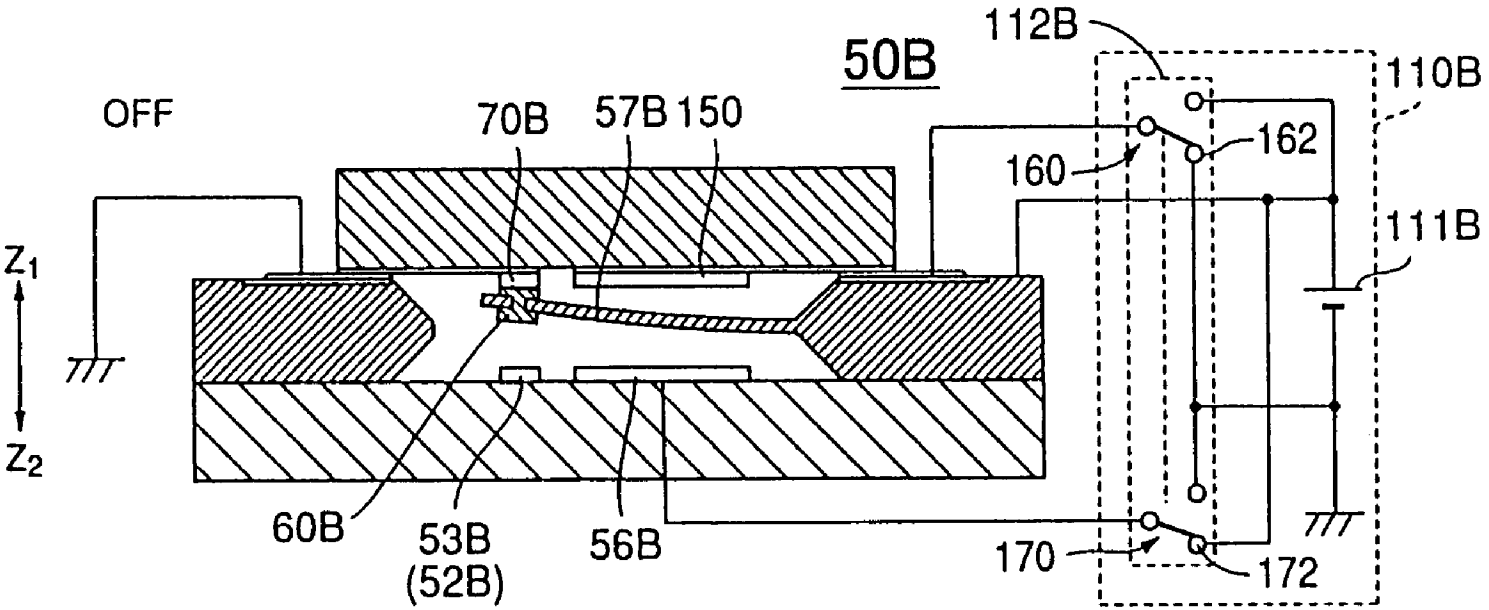

In an operating state, the first switch 160 and the second switch 170 are switched together. As shown in FIG. 12A, when the first and second switches 160 and 170 are connected to the stationary contacts 161 and 171, respectively, voltage is applied between the movable plate 57B and the stationary electrode 56B to generate the electrostatic attractive force. The movable plate 57B is bent in the Z2 direction, and the movable contact 60B contacts the stationary contacts 52B and 53B. The micro relay 50B is turned on. As shown in FIG. 12B, when the first and second switches 160 and 170 are connected to the stationary contacts 162 and 172, respectively, the electrostatic attractive force generated between the movable plate 57 and the stationary electrode 56 vanishes. To the contrary, voltage is applied between the movable plate 57B and the stationary electrode 150, and electrostatic attractive force is generated. The movable contact 60 separates from the stationary contacts 52B and 53B because of the elastic restorative force of the movable plate 57, and at the same time, the movable plate 57 bends in the Z1 direction beyond the horizontal position due to the electrostatic attractive force generated between the movable plate 57 and the stationary electrode 150. The movable contact 60 touches the ground contact 70B. Because the movable contact 60B separates the stationary contacts 52B and 53B, the micro relay 50B is turned off. The movable contact 60B is grounded by contacting the ground contact 70B. Since the electrostatic capacitance connection between the movable contact 60B and the stationary contacts 52B, 53B is eliminated, the micro relay 50B realizes an acceptable isolation property.

When the first switch 160 and the second switch 170 are set at the position shown in FIG. 11, the voltage between the movable plate 57B and the stationary electrode 150 is removed, and the electrostatic attractive force vanishes. Accordingly, the micro relay 50B is set in the non-operating state. The movable plate 57B returns to the original horizontal position by its elastic restorative force. The movable contact 60B separates from the ground contact 70B and stays off both the ground contact 70B and the stationary contacts 52B, 53B.

In addition, the drive circuit 110B shown in FIG. 11 is just an example. The configuration of the drive circuit is not limited to this example.

[The Third Embodiment]

Figure 13:
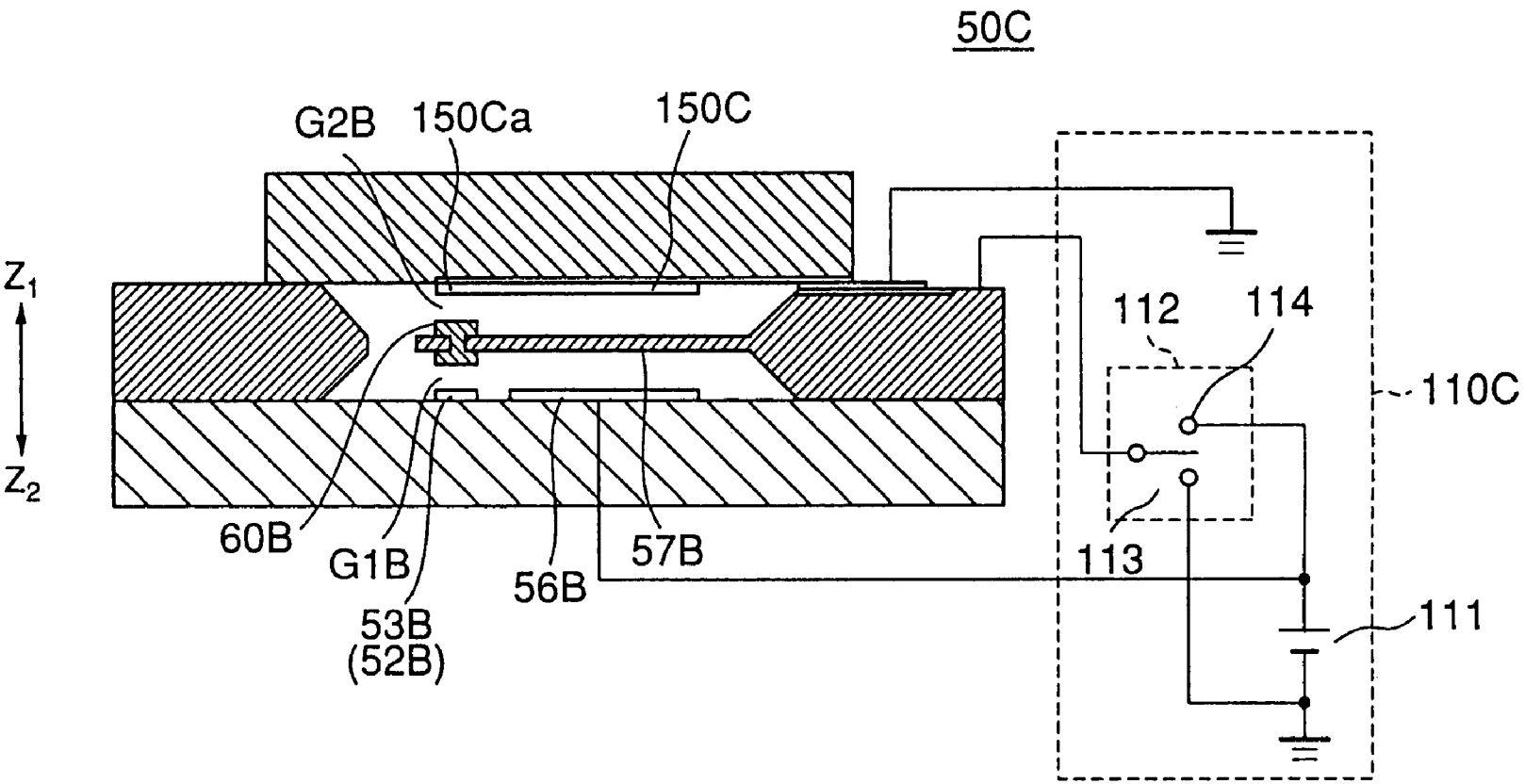
FIG. 13 is a sectional view showing a micro relay according to the third embodiment of the present invention.

FIG. 13 shows an SPST type micro relay 50C according to the third embodiment of the present invention. The micro relay 50C is a variation of the micro relay 50B shown in FIG. 11.

This micro relay 50C is different from the micro relay 50B shown in FIG. 11, in that the stationary electrode 150 and the ground contact 70B are monolithic. The end portion 150Ca of a monolithic stationary electrode 150C functions as the ground contact.

A drive circuit 110C is substantially the same as the drive circuit 110 shown in FIG. 4. The stationary electrode 150C is maintained at the ground level. A positive voltage is always applied to the stationary electrode 56B at the lower side. The voltage applied to the movable plate 57B is switched between the positive voltage and the ground voltage by switching the switch 112.

In the non-operating state, as shown in FIG. 13, the switch 112 is at a neutral position in which it is not in contact with either stationary contact 114 or 115. There is no electrostatic attractive force generated between the movable plate 57B and the stationary electrode 56B and between the movable plate 57B and the stationary electrode 150C. The movable plate 57B stays at the horizontal position, and the gaps G1B and G2B are formed. Accordingly, there is no risk that the movable contact 60B sticks to the end portion 150Ca of the stationary electrode 150C.

The switch 112 is operated to activate the micro relay 50C. When the movable contact 113 is connected to the stationary contact 115, an electrostatic attractive force is generated between the lower stationary electrode 56B and the movable plate 57B. The movable plate 57B is bent in the Z2 direction. The movable contact 60B touches the stationary contacts 52B and 53B, which turns on the micro relay 50C. When the movable contact 113 is connected to the stationary contact 114, the movable plate 57B and the stationary electrode 150C attract each other by the electrostatic force generated between them so that the movable plate 57B is bent in the Z1 direction. The movable contact 60B separates from the stationary contacts 52B and 53B and touches the end portion 150Ca of the stationary electrode 150C. The micro relay 50C is turned off. Accordingly, the micro relay 50C shows acceptable isolation property.

[The Fourth Embodiment]

Figure 14:
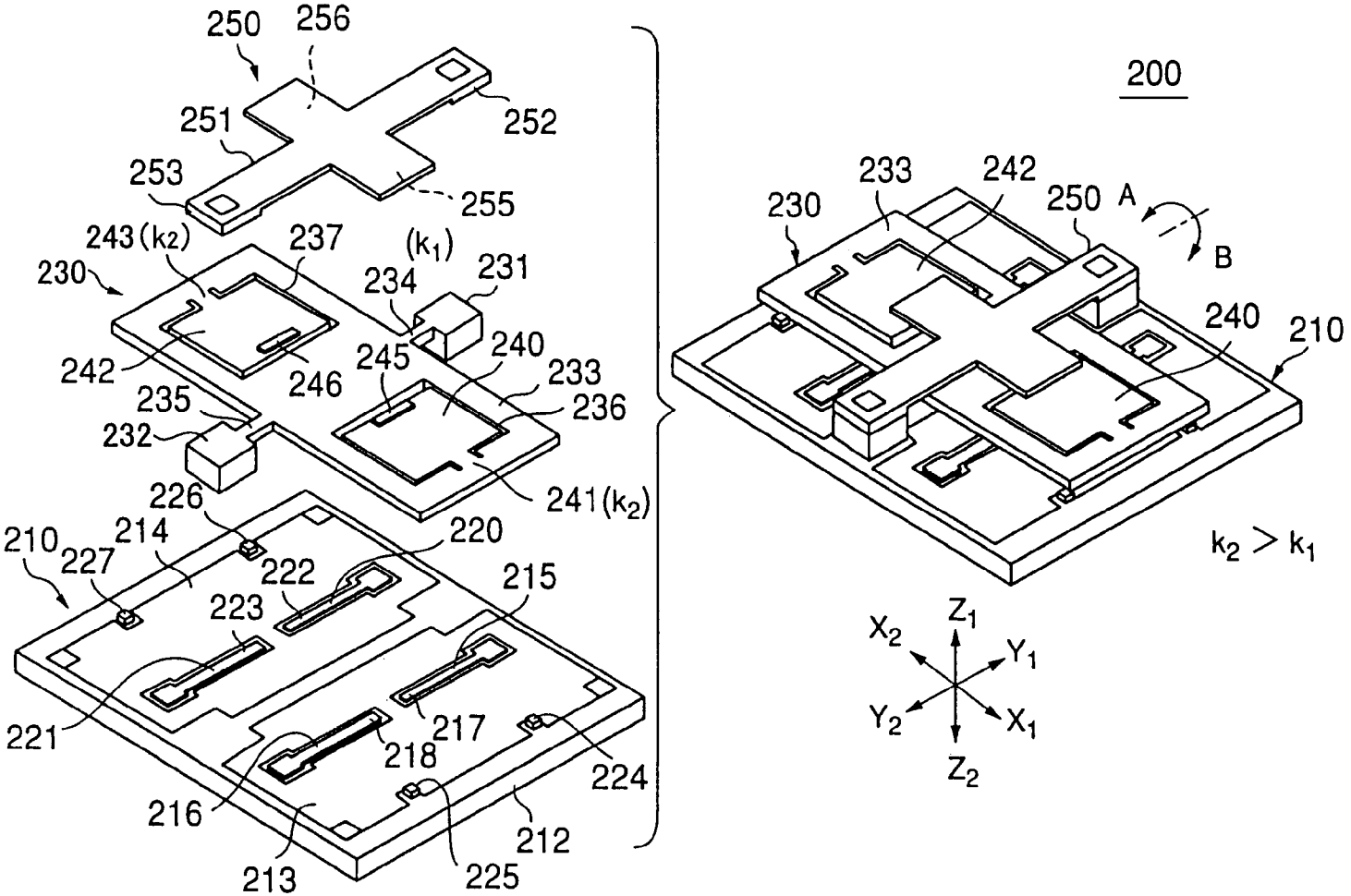
FIG. 14 is an exploded development view showing a micro relay according to the fourth embodiment of the present invention.
Figure 15:
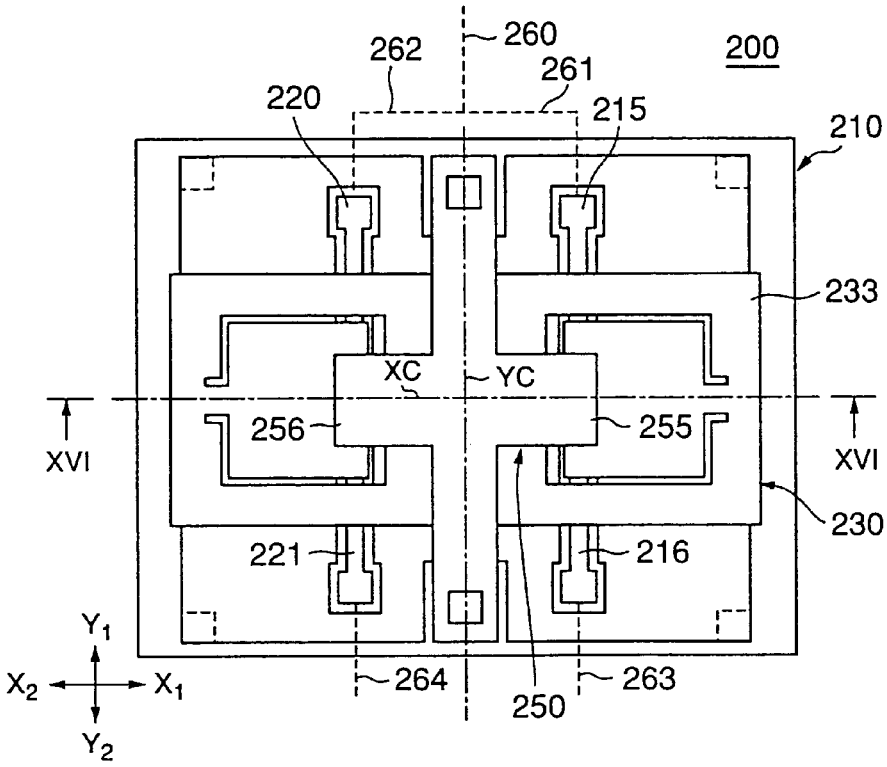
FIG. 15 is a top view showing the micro relay shown in FIG. 14.
Figure 16:
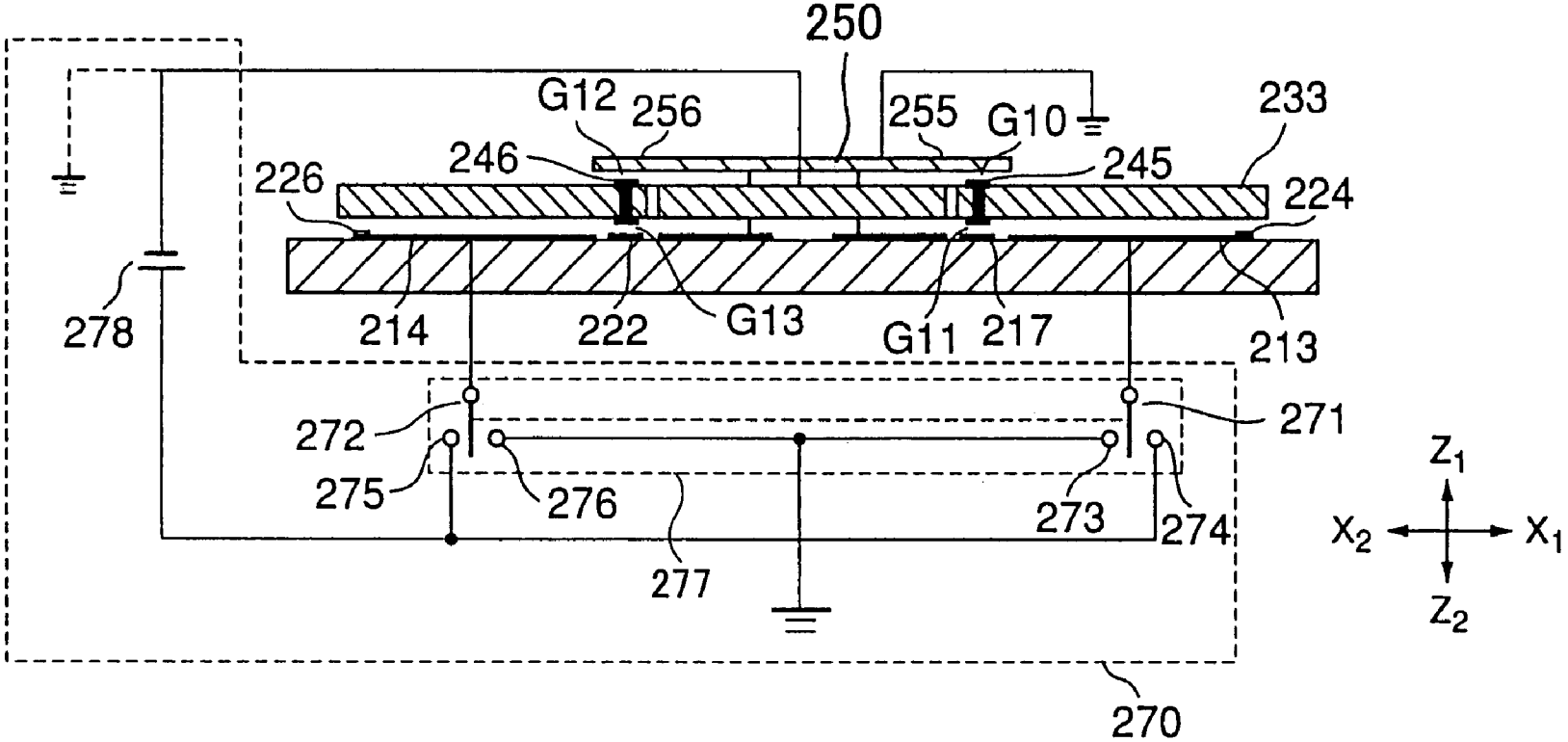
FIG. 16 is a sectional view showing the micro relay shown in FIG. 15, along the perpendicular plane including the XVI—XVI line.

FIGS. 14, 15, and 16 show a seesaw type micro relay 200 according to the fourth embodiment of the present invention. X1–X2 indicates the length directions; Y1–Y2 indicates the width directions; and Z1–Z2 indicates the height directions.

The micro relay 200 includes a fixed substrate unit 210, a movable unit 230 that moves with a seesaw motion, and a ground terminal unit 250 accumulated in that order. The micro relay 200 is symmetrical with respect to a center line YC extending in the Y1–Y2 directions and symmetrical with respect to another center line XC extending in the X1–X2 directions as shown in FIG. 15.

The fixed substrate unit 210 includes the following: an X1-side stationary electrode 213, an X2-side stationary electrode 214, X1-side signal lines 215, 216, X1-side stationary contacts 217, 218, X2-side signal lines 220, 221, X2-side stationary contacts 222, 223, X1-side stoppers 224, 225, and X2-side stoppers 226, 227 provided on a fixed substrate 212.

The X1-side stationary electrode 213 and the X2-side stationary electrode 214 are formed in the half region at the X1-side and the half region at the X2-side, respectively, of the fixed substrate 212.

The X1-side signal lines 215 and 216 are formed in regions in which the X1-side stationary electrode 213 is clipped and aligned in the Y1–Y2 directions. The X1-side signal lines 215 and 216 have the X1-side stationary contacts 217 and 218 at the ends facing each other.

The X2-side signal lines 220 and 221 are formed in regions in which the X2-side stationary electrode 214 is clipped and aligned in the Y1–Y2 directions. The X2-side signal lines 220 and 221 have the X2-side stationary contacts 222 and 223.

The stoppers 224 and 225 are formed in a peripheral region at the X1-side of the stationary electrode 213. The stoppers 226 and 227 are formed in a peripheral region at the X2-side of the stationary electrode 214. All of the stoppers 224, 225, 226, and 227 are made of, or covered by, insulating material such as $Si_3N_4$ having high abrasion resistance and high slidability. The stoppers 224–227 protrudes from the top face of the stationary electrodes 213 and 214 towards the free edge of the movable plate 233 that will be described later.

The movable unit 230 is made of silicon and includes the following: anchor units 231, 232, a movable plate 233, and supporting spring units 234, 235 provided between the movable plate 233 and the anchor unit 231 and between the movable plate 233 and the anchor unit 232, respectively. The movable plate 233 is shaped like a rectangle that is long in the X1–X2 directions. The movable plate 233 is supported by the anchor units 231 and 232 fixed to the movable plate 233 by the corresponding supporting spring units 234 and 235 at the center in the X1–X2 directions. The movable plate 233 moves seesaw in the rotative directions A–B by the torsional deformation of the supporting spring units 234 and 235. The total spring constant of the supporting spring unit 234 and the supporting spring unit 235 is k1.

There are substantially rectangular slits 236 and 237 in the movable plate 233, which form flap units 240, 242 and leaf spring units 241, 243. The leaf spring unit 241 is positioned at the end in the X1 direction of the movable plate 233. The leaf spring unit 243 is positioned at the end in the X2 direction of the movable plate 233. Movable contacts 245 and 246 are formed at the free edge side of the flap units 240 and 242, respectively, each movable contact 245 and 246 being formed through a through hole and protruding from the top face and the bottom face of the flap unit 240 and 242, respectively. The spring constant of each leaf spring unit 241 and 243 is k2 that is greater than the spring constant k1.

The ground terminal unit 250 is made of conductive material such as silicon and metal. The ground terminal unit 250 includes a cross-shaped plate unit 251 and anchor units 252 and 253 at the ends of this cross-shaped plate unit 251. The cross-shaped plate unit 251 has ground contacts 255 and 256 at the ends of arm portions extending in the X1–X2 directions.

The anchor units 231 and 232 of the movable unit 230 are fixed on the fixed substrate 212. The anchor units 252 and 253 of the ground terminal unit 250 are fixed on the anchor units 231 and 232 of the movable unit 230. The movable unit 233 and the cross-shaped plate unit 251 are parallel to the fixed substrate 212.

As shown in FIG. 15, the micro relay 200 is connected to signal lines on a printed board before it is used. The printed board has a signal line 260, signal lines 261 and 262 branched from the signal line 260, and other signal lines 263 and 264. The signal lines 215, 220, 216, and 221 of the micro relay 200 are connected to the signal lines 261, 262, 263, and 264, respectively. Additionally, as shown in FIG. 16, the micro relay 200 is connected to a drive circuit 270. The drive circuit 270 includes a switch 277 in which the first switch 271 and the second switch 272 operate together, and a power supply 278. A negative voltage is applied to the movable plate 233. The ground terminal unit 250 is grounded.

As shown by two-dot chain line in FIG. 16, the negative side of the power supply 278 may be grounded. In this case, the grounding dedicated to the ground terminal unit 250 is not needed, which results in improved simplicity of wiring. The movable unit 230 remains at the ground voltage.

As shown in FIG. 16, in the non-operating state, both the first switch 271 and the second switch 272 are not in contact with stationary contacts. No voltage is applied to the stationary electrodes 213 and 214, and consequently, no electrostatic attractive force is generated between the movable plate 233 and the X1-side stationary electrode 213 and between the movable plate 233 and the X-2 side stationary electrode 214. The movable plate is at the horizontal position. There is a gap G10 between the movable contact 245 and the ground contact 255, and there is another gap G12 between the movable contact 246 and the ground contact 256. Accordingly, the movable contact 245 does not stick to the ground contact 255, and the movable contact 246 does not stick to the ground contact 256. Of course, there is a gap G11 between the movable contact 245 and the stationary contact 217, and there is a gap G13 between the movable contact 246 and the stationary contact 222.

Figure 17A:
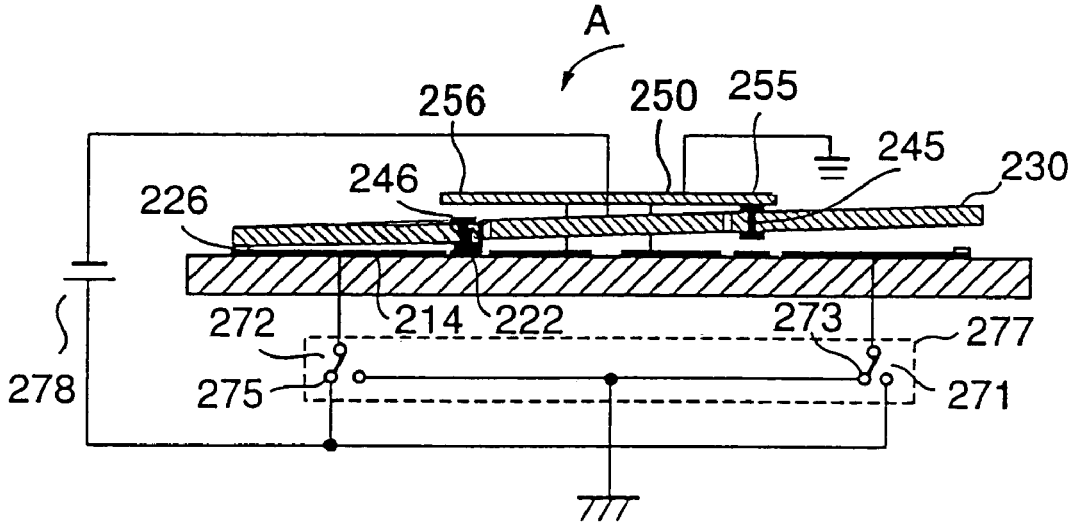
FIGS. 17A–17B are schematic drawings showing operational states of the micro relays shown in FIGS. 14 to 16.
Figure 17B:
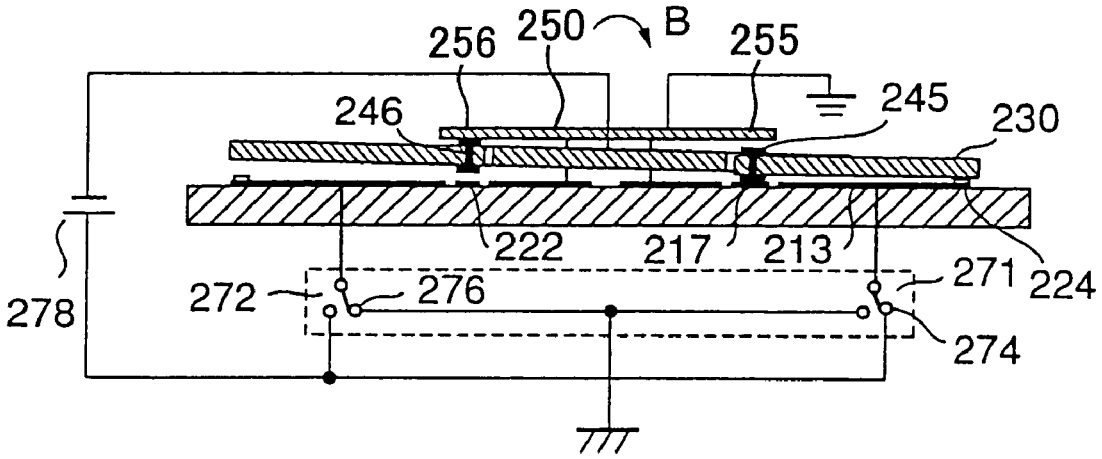

In the operating state, the switch 277 is switched as shown in FIGS. 17A and 17B. As shown in FIG. 17A, when the switch 277 is switched so that the first switch 271 and the second switch 272 contact the stationary contacts 273 and 275, respectively, a voltage is applied between the stationary electrode 214 and the movable plate 233. Because an electrostatic attractive force is generated between the stationary electrode 214 and the movable plate 233, the movable plate 233 rotates in the A direction until it touches the stoppers 226 and 227. The movable contact 246 touches the stationary contacts 222 and 223, and the signal lines 220 and 221 are connected. The opposite movable contact 245 touches the ground contact 255 and is consequently grounded. Accordingly, the micro relay 200 exhibits an acceptable isolation property.

As shown in FIG. 17B, when the switch 277 is switched so that the first switch 271 and the second switch 272 are connected to the stationary contacts 274 and 276, respectively, a voltage is applied between the stationary electrode 213 and the movable plate 233. The movable plate 233 rotates in the rotative direction indicated "B" by the electrostatic attractive force generated between the movable plate 233 and the stationary electrode 213 until the movable plate 233 touches the stoppers 224 and 225. The movable contact 245 contacts the stationary contacts 217 and 218 so that the signal line 215 and the signal line 216 are connected. The opposite movable contact 246 touches the ground contact 256 and is grounded. Accordingly, the micro relay 200 exhibits an acceptable isolation between the signal line 220 and the signal line 221.

When the switch 277 is reset at the position shown in FIG. 16 afterwards, the above electrostatic attractive force vanishes. The micro relay 200 is set at the non-operating state. The movable plate 233 returns to the horizontal position by the elastic restorative force of the supporting spring units 234 and 235. The gaps G10 and G12 appear.

The drive circuit 270 in FIG. 16 is just an example. The configuration of the drive circuit 270 is not limited to this example.

The following description explains the operation in which the movable plate 233 is rotated in the rotative direction "A" until the movable plate 233 is stopped by the stoppers 226 and 227, and the movable contact 246 touches the stationary contacts 222 and 223 by reference to FIG. 18.

Figure 18A:
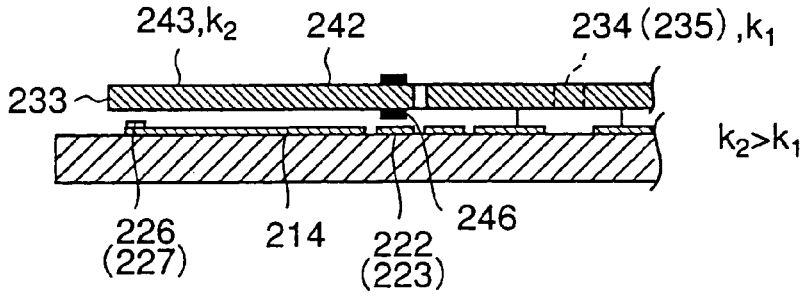
FIGS. 18A–18C are schematic drawings showing a mechanism (movable unit) in which a movable contact touches a stationary contact according to the present invention.
Figure 18B:
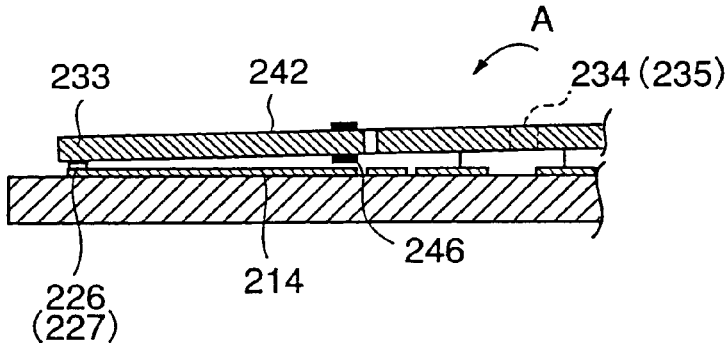

FIG. 18A shows the initial state; FIG. 18B shows the intermediate state; and FIG. 18C shows the final state.

The spring constant k2 of the plate spring unit 243 is greater than the total spring constant k1 of the supporting spring unit 234 and the supporting spring unit 235. When the movable plate 233 and the stationary electrode 214 are attracted to each other by the electrostatic force, the supporting spring units 234 and 235 are deformed by torsion so that the movable plate 233 rotates in the rotative direction "A" and touches the stoppers 226 and 227, but the leaf spring unit 243 does not bend.

Figure 18C:
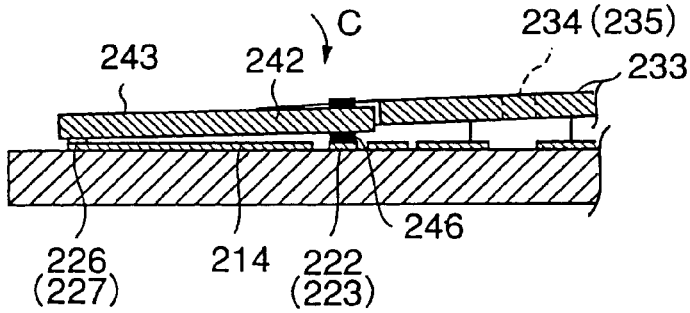

Subsequently, as shown in FIG. 18C, the leaf spring unit 243 is bent and the flap unit 242 rotates in the rotative direction "C" so that the movable contact 246 touches the stationary contacts 222 and 223.

When the state shown in FIG. 18A turns into the state shown in FIG. 18B, the flap unit 242 approaches the stationary electrode 214 so that the gap between them narrows. Accordingly, the electrostatic attractive force generated between the flap unit 242 and the stationary electrode 214 becomes substantially greater than that generated in the state shown in FIG. 18A. The leaf spring unit 243 is bent.

When the voltage applied to the stationary electrode 214 in the state shown in FIG. 18C is removed, the movable plate 233 and the flap unit 242 are restored to the state shown in FIG. 18A by the elastic restorative force stored in the leaf spring unit 243 and the supporting spring units 234 and 235. The movable plate 233 and the flap unit 242 are restored by the restorative force stored in both the leaf spring unit 243 and the supporting spring units 234 and 235. Accordingly, the movable contact 246 separates from the stationary contacts 222 and 223 smoothly.

In addition, the stoppers 226 and 227 hold the movable plate 233 so as to prevent the movable plate 233 from sticking to the stationary electrode 214.

Furthermore, the embodiment of the above micro relay 200 can operate without the ground terminal unit 250.

Figure 19:
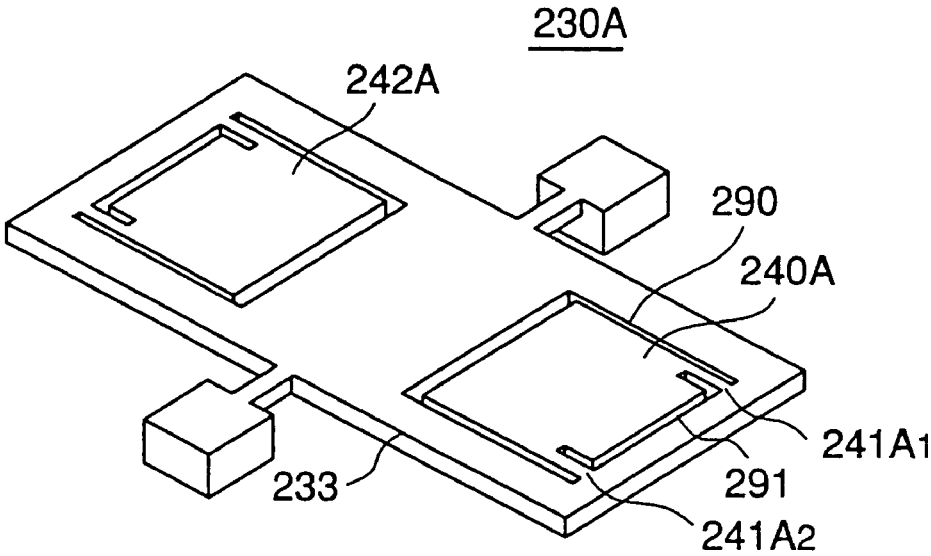
FIG. 19 is a schematic diagram showing the first variation of the movable unit.

FIG. 19 shows a movable unit 230A according to the first variation of the fourth embodiment. The flap unit 240A is supported by two plate spring units 241A1 and 241A2 one on each side. The flap unit 240A and the plate spring units 241A1 and 241A2 are formed by a large U-shaped slit 290 and a small U-shaped slit 291 formed in the movable plate 233. As a result, the spring constant k2 can be adjusted properly.

Figure 20:
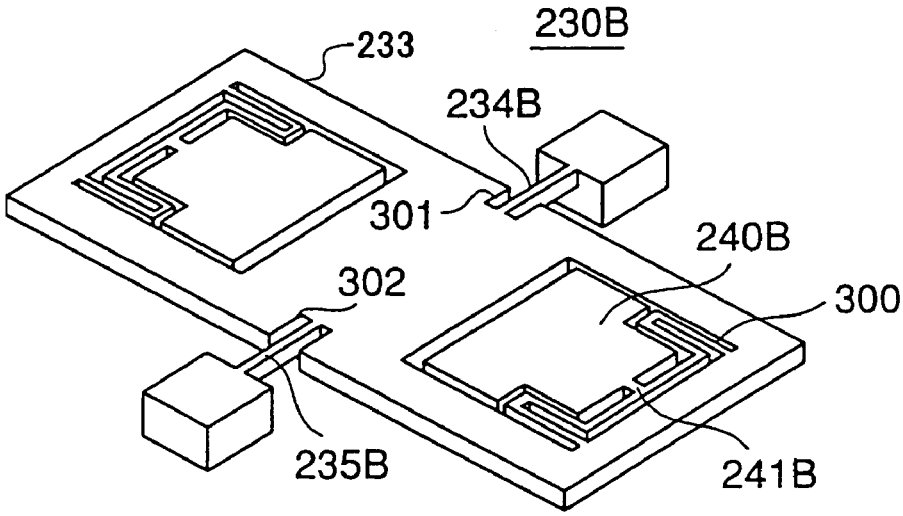
FIG. 20 is a schematic diagram showing the second variation of the movable unit.

FIG. 20 shows a movable unit 230B according to the second variation of the fourth embodiment. The plate spring unit 241B of the flap unit 240B is formed by a complicated slit 300. The supporting spring units 234B and 235B are longer than the supporting spring units 234 and 235 shown in FIG. 14 because of the slits formed in the movable plate 233. Accordingly, the spring constant k1 can be adjusted properly as well as the spring constant k2.

In addition, one can activate the micro relays 50, 50B, 50C, and 200 according to the above embodiments by electromagnetic force, piezoelectric distortion, thermal expansion, and so forth, instead of electrostatic attractive force by appropriately modifying the structure of the micro relays 50, 50B, 50C, and 200.

In summary, according to an aspect of the present invention, a micro relay includes a movable contact, a stationary contact, and a ground contact opposed to said movable contact, wherein in an operating state, said movable contact touches said ground contact when said movable contact separates from said stationary contact, and in a non-operating state, said movable contact remains separated from said ground contact.

In the operating state, the movable contact touches the ground contact and is set at the ground voltage level when the movable contact separates from the stationary contact. Since no parasitic capacitance is formed between the stationary contact and the movable contact, the isolation property of the micro relay is improved.

In the non-operating state, the movable contact separates from the ground contact so that the movable contact does not stick to the ground contact. Accordingly, the micro relay operates at a high reliability even at the beginning of the operation.

According to another aspect of the present invention, in the micro relay described above, a gap between said movable contact and said ground contact in said non-operating state is smaller than a gap between said movable contact and said stationary contact. Accordingly, the movable contact is required to move only a short distance to touch the ground contact.

According to yet another aspect of the present invention, the micro relay described above further includes a movable plate shaped like a cantilever, on which said movable contact is provided a first stationary electrode opposed to said movable plate, provided at a side of said stationary contact, and a second stationary electrode opposed to said movable plate, provided at a side of said ground contact.

The attractive force that has the movable contact move toward and touch the ground contact is the electrostatic attractive force generated between the movable plate and the second stationary electrode. Even if the gap between the movable contact and the ground contact is large, the electrostatic attractive force can move the movable contact toward and touch the ground contact for sure. In addition, since the gap between the movable contact and the ground contact is large, the micro relay according to the present invention is easy to manufacture.

According to yet another aspect of the present invention, the micro relay described above further includes a movable plate that can rotate around a center on which said movable contact and another movable contact are provided on both sides thereof, respectively, and a supporting spring unit supporting said movable plate at said center, wherein, in the operating state, said movable contact touches said ground contact when said movable contact separates from said stationary contact, and, in a non-operating state, both said movable contact and the other movable contact remain separated from said ground contact. Accordingly, the isolation property of this SPDT type micro relay is improved, and the sticking of the movable contact to the ground contact is surely avoided.

According to yet another aspect of the present invention, in the micro relay described above, said movable plate further comprises two flap units and two leaf spring units, each flap unit being formed by a slit, and the leaf spring units being positioned on both side of said movable plate, each leaf spring unit supporting corresponding flap unit to said movable plate, said movable contact and the other contact are provided on a free edge side of corresponding flap unit, and said movable contact moves with a rotation of said movable plate involving elastic deformation of said supporting spring unit and with a rotation of said flap unit involving elastic deformation of said leaf spring unit. Accordingly, the movable contact is smoothly separated by the spring force stored by both the supporting spring unit and the leaf spring unit.

According to yet another aspect of the present invention, the micro relay described above further includes a stopper that stops said rotation of said movable plate by touching a point of said movable plate. Accordingly, the movable plate is stopped by the stopper so that the sticking of the movable plate to the stationary electrode is avoided.

According to yet another aspect of the present invention, a method of manufacturing a micro relay described above includes the steps of forming a movable contact, forming a sacrificial layer that covers the formed movable contact, forming a ground contact on the formed sacrificial layer, and removing said sacrificial layer, wherein the formed sacrificial layer is removed so that said movable contact separates from said ground contact. Accordingly, the gap length between the movable contact and the ground contact can be controlled by the thickness of the sacrificial layer. The gap can be formed at a high precision.

According to yet another aspect of the present invention, a micro relay includes a movable plate that can rotate involving torsional deformation of supporting spring unit provided at a center of said movable plate, wherein said movable plate further comprises two flap units and two leaf spring units, each flap unit being formed by a slit, and the leaf spring units being positioned on both side of said movable plate, each leaf spring unit supporting the corresponding flap unit to said movable plate, said movable contact and the other contact are provided on a free edge side of the corresponding flap unit, and said movable contact moves with a rotation of said movable plate involving elastic deformation of said supporting spring unit and with a rotation of said flap unit involving elastic deformation of said leaf spring unit. Accordingly, the movable contact is smoothly separated by the spring force stored by both the supporting spring unit and the leaf spring unit.

The present invention is not limited to these embodiments, but various variations and modifications may be made without departing from the scope of the present invention.

This patent application is based on Japanese priority patent application No. 2002-042033 filed on Feb. 19, 2002, the entire contents of which are hereby incorporated by reference.

What is claimed is:

1. A micro relay having a base, comprising:

a movable plate supported by first and second supporting spring units extending from center positions on opposite edges of the movable plate and having respective, opposite ends supported on the base and defining a centrally disposed axis of rotation of the moveable plate, the moveable plate further comprising:

first and second flap units formed in symmetrically spaced portions of the moveable plate, relatively to the axis of rotation, by corresponding slit in the moveable plate and connected by corresponding first and second leaf springs to respective, first and second end portions of the moveable plate, the flap units being resiliently maintained in a common plane with the moveable plate by the corresponding leaf springs, and first and second moveable contacts mounted on corresponding free ends of the respective first and second flap units and moveable with rotation of the moveable plate, the rotation producing elastic deformation of the first and second supporting spring units;

first and second stationary contacts aligned with the respective, first and second moveable contacts and, in a non-operating state, spaced from one of the corresponding lower and upper ends of the respective, first and second moveable contacts;

a ground contact aligned with, and, in a non-operating state, spaced from the other of the corresponding lower and upper ends of the respective, first and second moveable contacts;

in an operating state, the moveable plate rotating about the axis of rotation and producing elastic deformation of the first and second supporting spring units and, further, elastic deformation of the first and second leaf spring units to bring a selected one of the first and second moveable contacts into contact with the respective one of said first and second ground contacts and to bring the other of the first and second moveable contacts into contact with the respective one of the first and second stationary contacts; and in a non-operating state, the moveable plate being in a position in which the first and second moveable contacts are resiliently maintained in a position spaced between and separated from the respective, first ground and first stationary contacts and respective, second ground and second stationary contacts.

2. The micro relay is claimed in claim 1, wherein:

in the operating state, the other of the first and second moveable contacts touches the respective one of the first and second stationary contacts when the one of the first and second moveable contacts separates from the respective one of the first and second ground contacts; and in the non-operating state, the other one of the first and second moveable contacts remains separated from the corresponding one of the ground contacts.

3. The micro relay as claimed in claim 1, further comprising:

a switch selectively connecting one of the stationary contacts to an external terminal; and a ground terminal selectively connected to one of the first and second ground contacts, wherein:

in the operating state, operation of the switch supplies a voltage to a selected one of the first and second stationary contacts, producing an electrostatic force causing the moveable plate to rotate about the axis of rotation in a first direction, bringing the corresponding one of the first and second moveable contacts into contact with the aligned, respective one of the first and second stationary contacts and bringing the other of the first and second moveable contacts into contact with the ground contact, and in the non-operating state, operation of the switch ends the voltage supply, the moveable plate rotating in a second, opposite direction in accordance with the stored energy of the elastic deformation of the supporting spring units and of the leaf spring units to a non-operating state position in which the first and second moveable contacts are spaced at intermediate, non-contacting positions between the respective, first and second ground contacts and first and second stationary contacts.

4. The micro relay as claimed in claim 1, wherein:

each of the first and second stationary contacts comprises a pair of spaced contacts; and each of the first and second moveable contacts, when contacting the respective first and second stationary contacts, completes a circuit between the two spaced portions thereof.

5. The micro relay as claimed in claim 1, wherein:

the first and second flap units and first and second leaf springs are integral parts of the moveable plate.

6. The micro relay as claimed in claim 5, wherein:

the first and second supporting spring units are integral parts of the moveable plate.

* * * * *

UNITED STATES PATENT AND TRADEMARK OFFICE

CERTIFICATE OF CORRECTION

PATENT NO. : 6,970,060 B2
APPLICATION NO. : 10/878233
DATED : November 29, 2005
INVENTOR(S) : Hideki Iwata et al.

It is certified that error appears in the above-identified patent and that said Letters Patent is hereby corrected as shown below:

Column 14, line 19, change “slit” to --slits--

Signed and Sealed this

Twenty-second Day of August, 2006

JON W. DUDAS
*Director of the United States Patent and Trademark Office*